United States Patent [19]

McKee et al.

[11] Patent Number: 4,460,230

[45] Date of Patent: Jul. 17, 1984

[54] CONNECTOR HOOD CONSTRUCTIONS

[75] Inventors: William H. McKee, West Covina, Calif.; Thomas M. Steinbach, Park Ridge, Ill.

[73] Assignee: TRW Inc., Elk Grove Village, Ill.

[21] Appl. No.: 187,544

[22] Filed: Sep. 16, 1980

Related U.S. Application Data

[63] Continuation of Ser. No. 14,355, Feb. 23, 1979, abandoned.

[51] Int. Cl.[3] ..... H01R 13/58

[52] U.S. Cl. ..... 339/106; 339/91 R; 339/92 M

[58] Field of Search ..... 339/91 R, 75 R, 75 P, 339/106, 107, 206, 208, 92 M

[56] References Cited

U.S. PATENT DOCUMENTS

| | | | |
|---|---|---|---|
| 2,384,267 | 9/1945 | Anderson | 173/328 |
| 3,329,925 | 7/1967 | Johnson et al. | 339/91 R |
| 3,398,390 | 8/1968 | Long | 339/91 |
| 3,408,614 | 10/1968 | Kuwahata | 339/91 |
| 3,566,336 | 2/1971 | Johnson et al. | 339/91 |
| 3,569,909 | 3/1971 | Carver | 339/91 |
| 3,582,867 | 6/1971 | Thompson et al. | 339/92 M |
| 3,662,321 | 5/1972 | Bury | 339/92 |
| 3,764,957 | 10/1973 | Iversen | 339/92 M |
| 3,781,766 | 12/1973 | Teagno et al. | 339/208 X |
| 3,881,797 | 5/1975 | Grandinetti | 339/106 |
| 3,904,265 | 9/1975 | Hollyday et al. | 339/103 |
| 3,920,306 | 11/1975 | Barnett et al. | 339/103 |
| 3,951,501 | 4/1976 | Baverle et al. | 339/91 |
| 3,989,343 | 11/1976 | Lucius | 339/128 |
| 4,002,389 | 1/1977 | Mammel | 339/103 M |
| 4,070,081 | 1/1978 | Takahashi | 339/91 R |
| 4,089,579 | 5/1978 | Steinbach | 339/91 |
| 4,108,527 | 8/1978 | Douty et al. | 339/107 |
| 4,125,312 | 11/1978 | Aimar | 339/208 X |
| 4,127,315 | 11/1978 | McKee | 339/103 |

FOREIGN PATENT DOCUMENTS

| | | |
|---|---|---|
| 2352419 | 12/1977 | France . |
| 773619 | 5/1957 | United Kingdom . |

OTHER PUBLICATIONS

McKee Application, Ser. No. 892,627, Filed 4-3-78

TRW-Catalog p. 24 & Related Drawings (2) EIA Standard RS-449, Nov. '77.

*Primary Examiner*—Eugene F. Desmond

*Attorney, Agent, or Firm*—Neuman, Williams, Anderson & Olson

[57] ABSTRACT

A multi-part hood construction for use with electrical connectors is provided which receives a first plug or receptacle connector in desired encompassed relation hereby conductor terminations of such connector are protectively covered. Opposed parts of said hood construction have mounted therein means for detachably securing such first connector-hood assembly in interlocking engagement with a second connector which intermates with the first connector. Such securing means may comprise pivotal latches or screws.

14 Claims, 23 Drawing Figures

FIG. 1
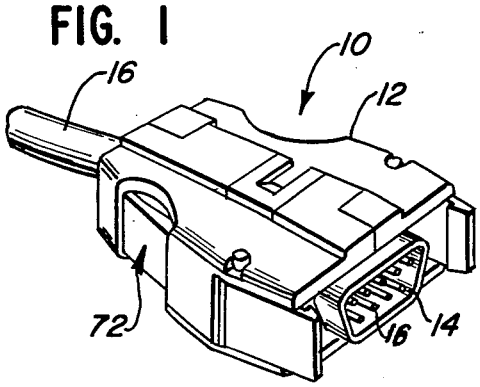
FIG. 2
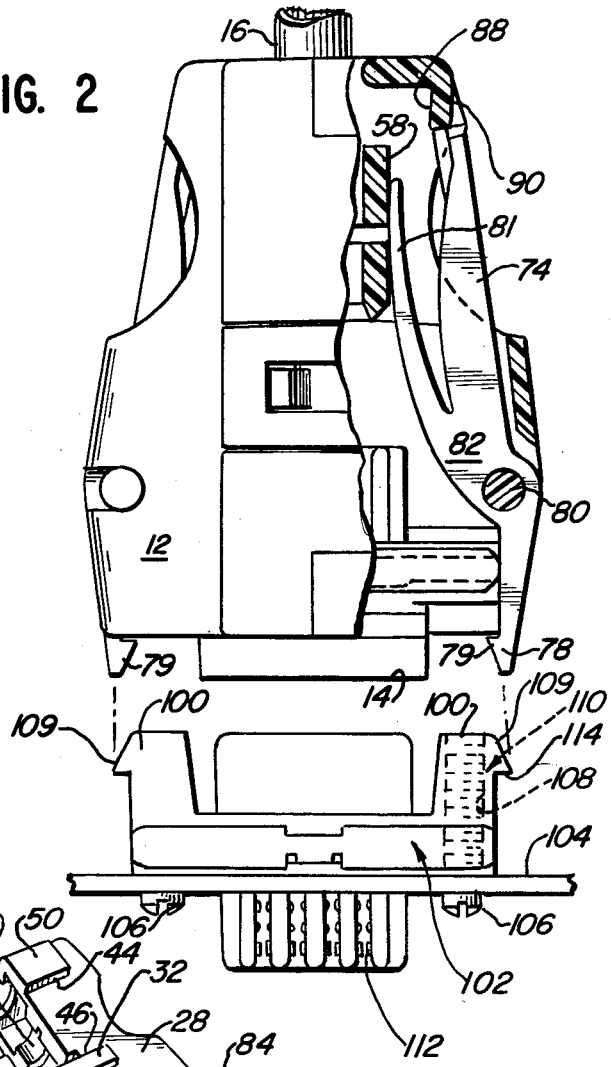
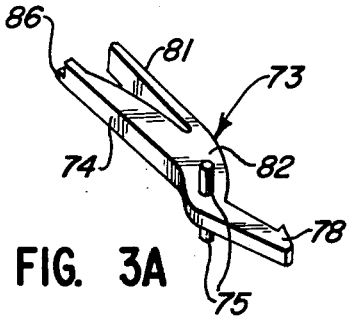
FIG. 3A
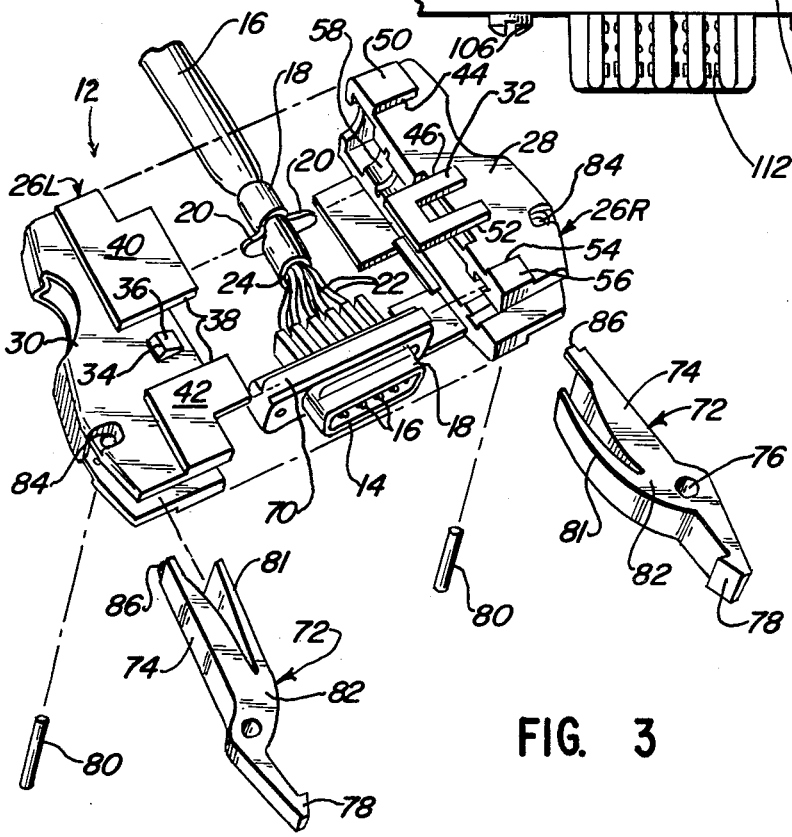
FIG. 3

FIG. 4
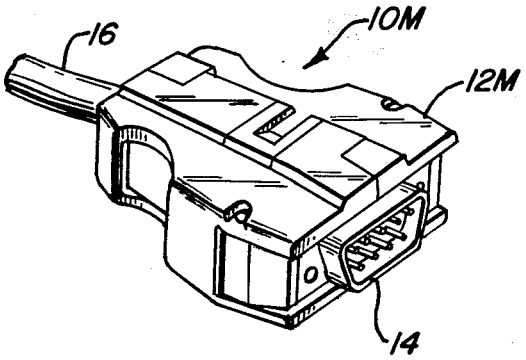
FIG 5
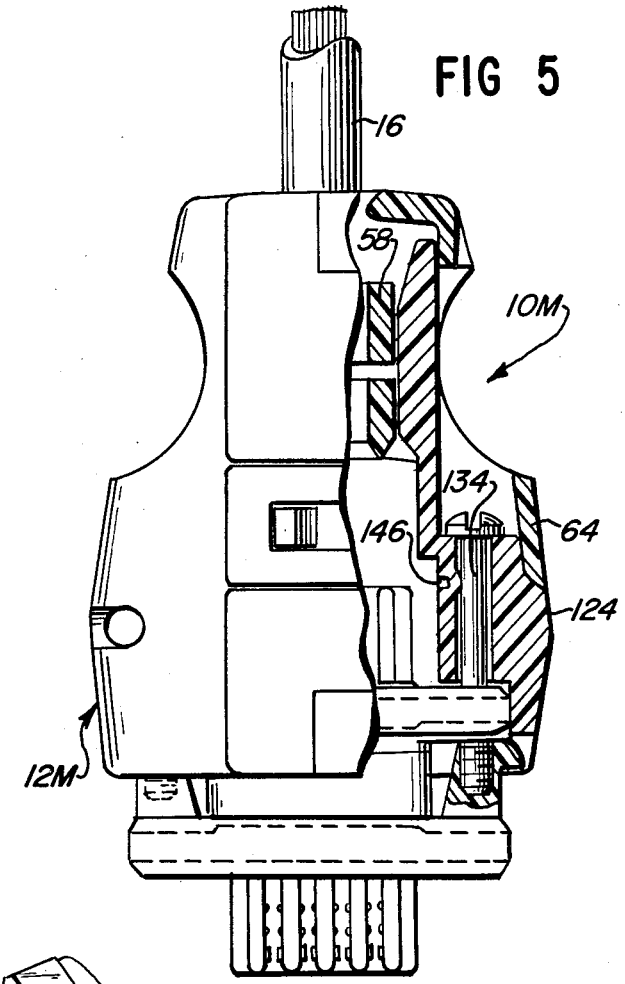
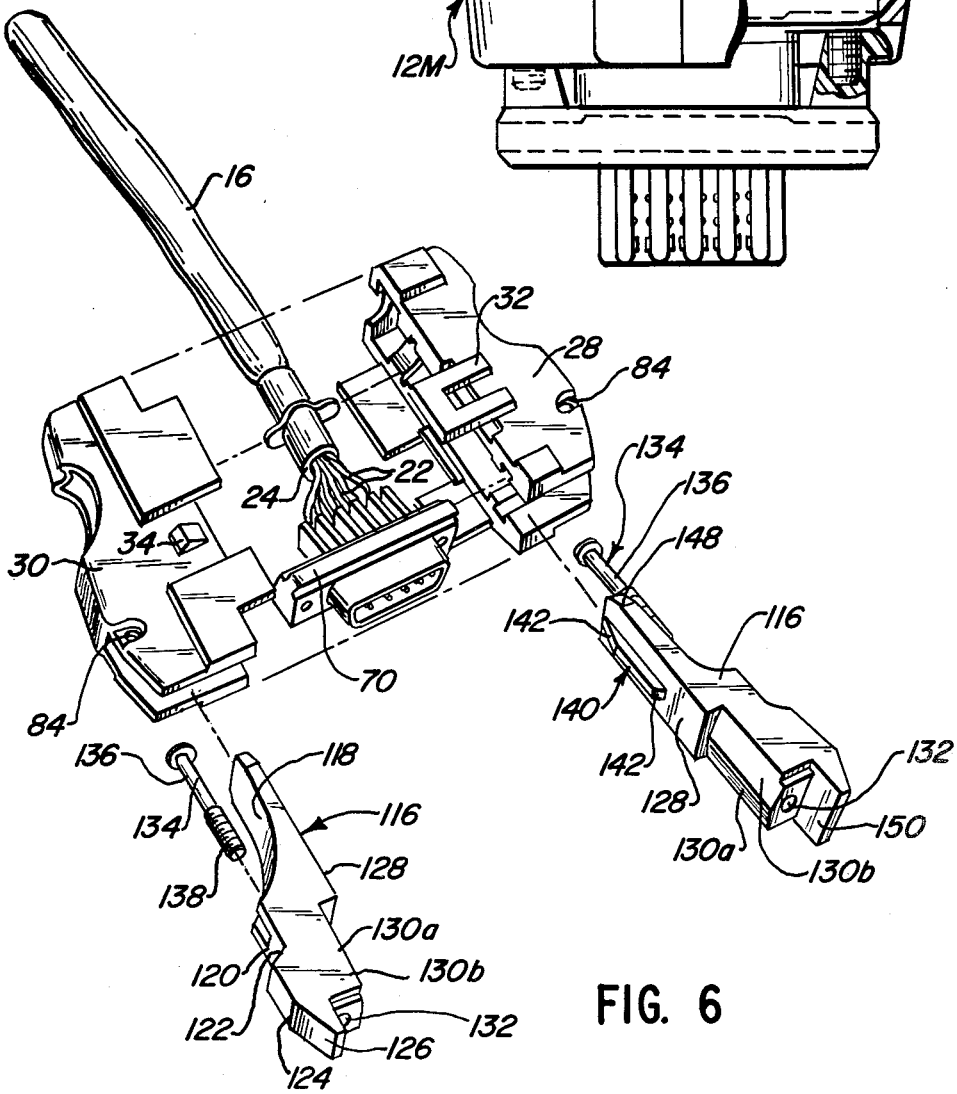
FIG. 6

FIG. 13
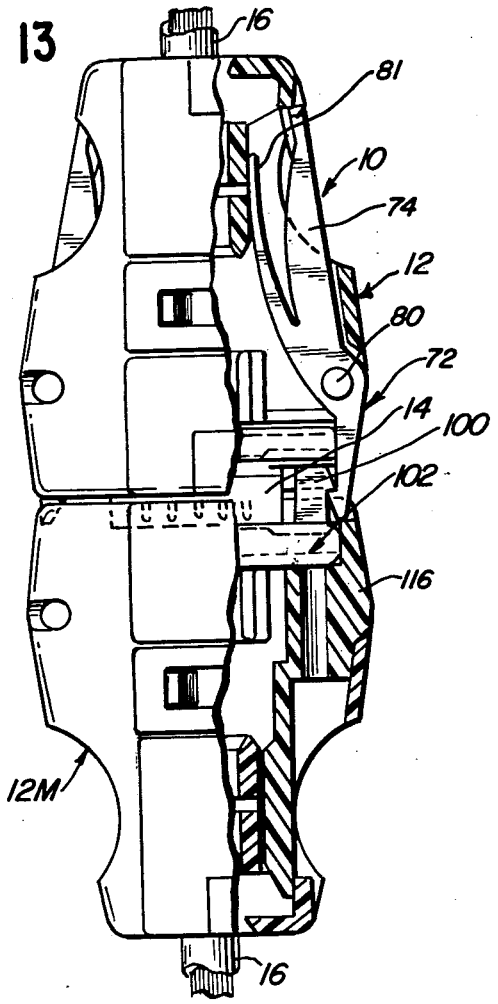
FIG. 14
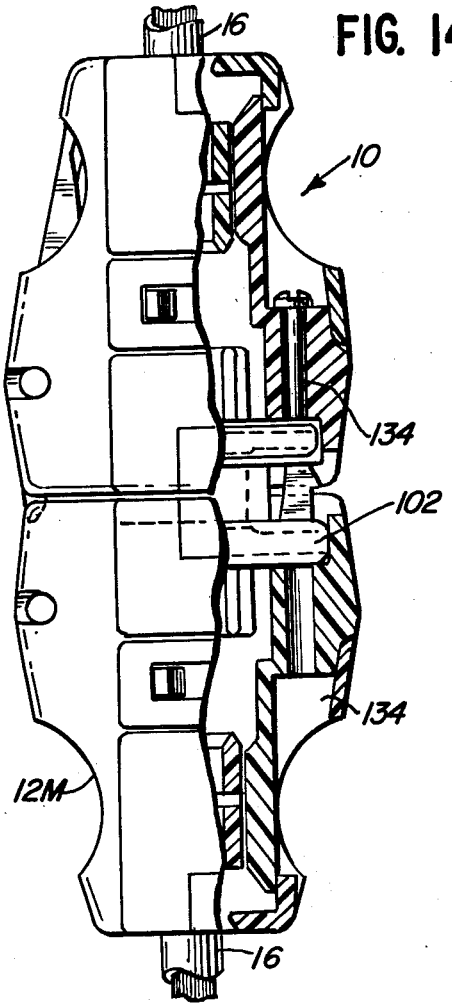
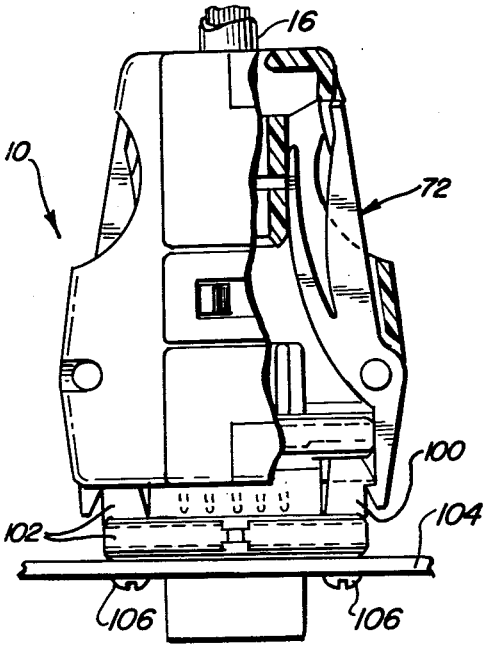
FIG. 15
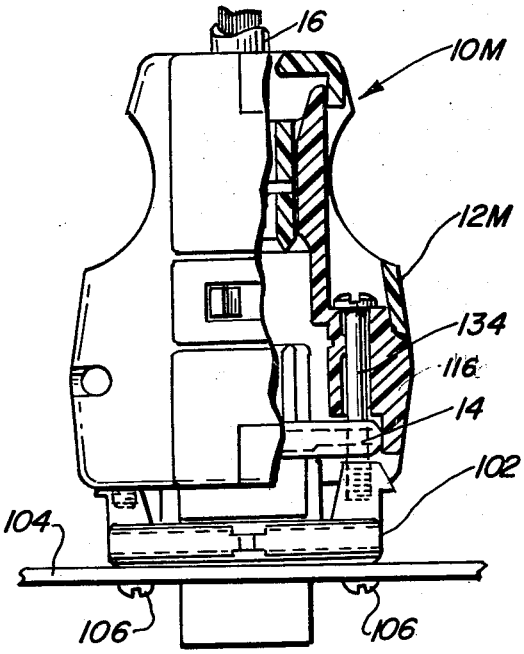
FIG. 16

FIG. 17
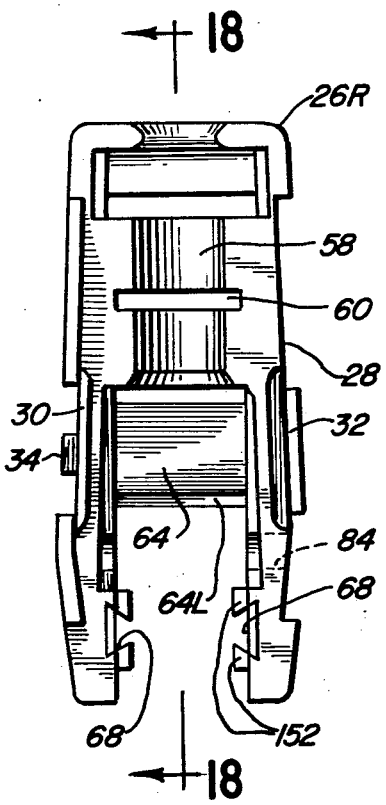
FIG. 18
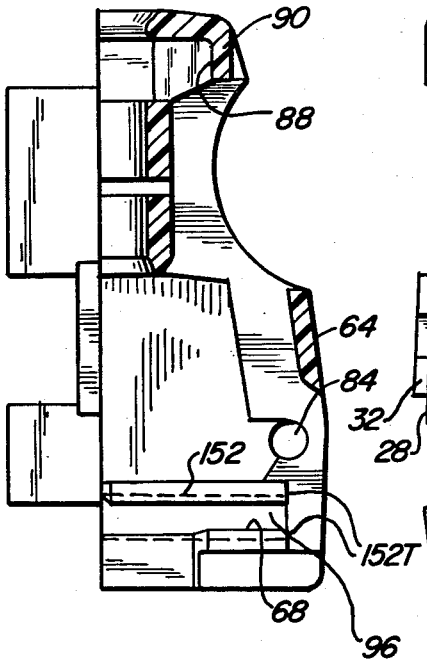
FIG. 19
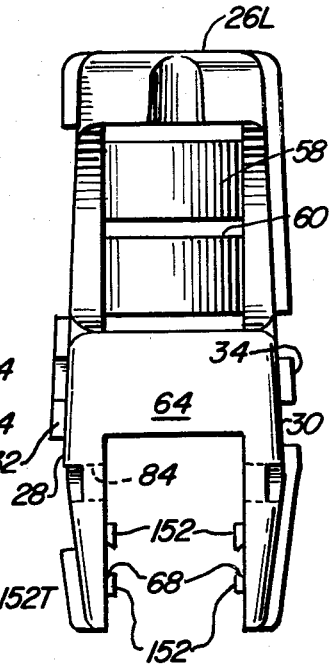
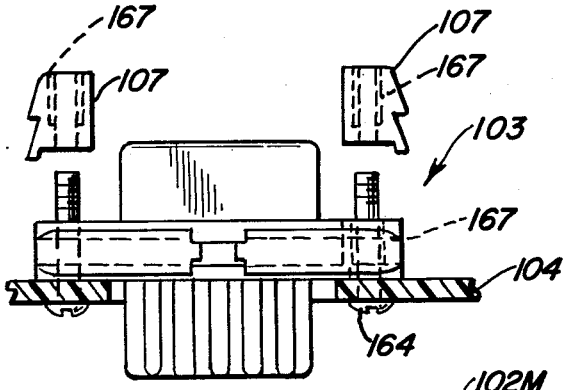
FIG. 20
FIG. 21
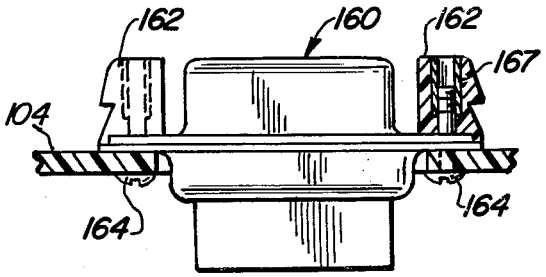
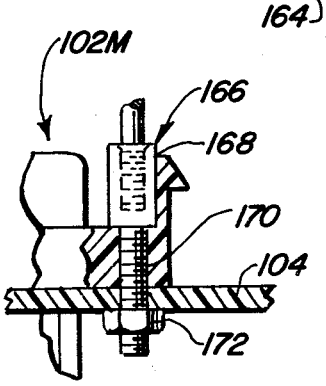
FIG. 22

CONNECTOR HOOD CONSTRUCTIONS

This is a continuation of application Ser. No. 14,355 filed Feb. 23, 1979 now abandoned.

This invention relates to hood constructions for use with electrical connectors, and more specifically, pertains to hood constructions which protectively encompass the conductor terminations of a first connector plug or receptacle while simultaneously engaging and retaining a second connector in mating engagement with such first connector.

The use of hoods attachable to electrical connectors for protectively containing wires terminated and attached to the contact terminals of such connectors is well-known in the prior art. A cable clamp which serves to function as a strain relief protecting the wire-connector terminations is often an integral part of such hoods. Bauerle U.S. Pat. No. 3,951,501 discloses a housing for an electrical connector in which a hinged cable clamp is formed with a hood construction enveloping such connector. Prior art hood constructions are also exemplified by those disclosed in Steinbach U.S. Pat. No. 4,089,579. This patent discloses hood constructions having an integral cable clamp and opposed side walls with inwardly projecting detents adapted to interlock with edge portions of a electrical connector.

In McKee U.S. Pat. No. 4,127,315, granted Nov. 28, 1978, a hood construction is disclosed adapted to interlock with an electrical connector at opposed end portions and having an internal chamber configured to accommodate a cable clamp mounted on a connector end portion. Such hood construction protects the connector from destructive forces which might otherwise be imparted to the connector as a result of forces applied to the cable clamped in the cable clamp.

McKee co-pending application Ser. No. 892,627 discloses a hood construction which is transversely split so as to define two halves which interlock with an encased connector and with themselves, and define a central cable entry. The entry is readily adjustable in cross-section by means of frangible straps to snugly engage a peripheral portion of an entering cable and thereby effect a strain relief function.

In all of the foregoing constructions the provided hoods interlockingly engage a single electrical connector, the contacts of which are protectively covered.

In accordance with this invention the provided hood comprises attaching means enabling the hood and enveloped connector to be securely and detachably connected to a second connector mating with the enveloped connector.

Thus, it is an object of this invention to provide an efficient hood which securely engages both an electrical connector whose terminations are protected, and a mating connector. The provided hood is constructed to simultaneously encase a connector to be protected and effect a strain relief function, and also simultaneously interlock with a second connector as the same mates with the encased connector.

It is another object of this invention to provide a hood construction comprising a basic housing in which different connector-engaging means may be disposed. Thus, the provided hood is extremely flexible in the normal course of use being adapted for utilization with a variety of connector members and combinations.

It is a still further object of this invention to provide a hood construction comprised of hermaphroditic, intermating halves which are readily snapped into an operative position of use with both an electrical connector to be protected as well as a connector mating therewith.

The above and other objects of this invention will become more apparent from the following detailed disclosure when read in the light of the accompanying drawings and appended claims.

In one embodiment of a hood invention made pursuant to this invention, two hood halves adapted to attachably interlock and provided which are reciprocally movable along a first axis. Each hood half has opposed side wall portions appropriately grooved to interlockingly engage opposed side edges of an electrical connector to be housed within the ultimately formed hood. In the interlocked condition the hood halves latch together by resilient, integrally formed latch portions which slidably interlock at the end of the hood halves' movement approaching each other. The hood halves join along a central plane transversely disposed to said axis of movement.

The hood clamp halves are structurally designed to receive in "snap-in" engagement spaced screw-retaining fillers whereby such screws may retain a connector housed with such hood and a connector mating with such housed connector together by threadedly engaging threaded bushings disposed in the mating connector.

As an alternative to the use of such screw-retaining fillers, the hood halves may have pivotally mounted therein by a "snap in" engagement or by means of a separate pivot pin, resiliently biased arms having latching detents disposed on distal portions thereof. The detents are designed to interlockingly engage with mating, latching detents disposed on opposed end portions of a connector mating with the housed connector.

The provided hood contruction thus possesses a flexibility of operation enabling it to efficiently function with a variety of connector constructions as will hereinafter be explained in greater detail.

For a more complete understanding of this invention reference will now be made to the drawings wherein:

FIG. 1 is a perspective view of an assembly comprising a hood of this invention in assembled relationship with an electrical connector;

FIG. 2 is a side elevational view broken away and partly in section illustrating the assembly of FIG. 1 in spaced apart relationship with a second electrical connector prior to mating with the electrical connector housed within the hood-connector assembly;

FIG. 3 is an exploded view of the assembly of FIG. 1 illustrating the various hood elements surrounding the electrical connector having conductors terminated therein;

FIG. 3A is a perspective view of modified latching means which may be employed in the assemblies of FIGS. 1–3;

FIG. 4 is a perspective view similar to FIG. 1 of a modified hood construction made in accordance with this invention and in assembled relationship with an electrical connector;

FIG. 5 is an elevational view broken away and partly in section illustrating an electrical connector secured to the hood-connector assembly of FIG. 4 by means of screws mounted in the overlying hood;

FIG. 6 is an exploded view similar to FIG. 3 illustrating the various elements of the hood-electrical connector assembly of FIG. 4;

FIG. 13 is a side elevational view broken away and partly in section of the hood-connector assembly of FIG. 1 in overlying relationship with the hood of FIG. 6 in engagement with a lug-bearing connector, the two hood connector assemblies being retained in assembled relationship by means of pivotally mounted latch arms having latching detents disposed on end portions thereof;

FIG. 14 is a side elevational view broken away and partly in section of two connector-hood assemblies employing the hood of FIG. 4 in engagement with connectors of different structure;

FIG. 15 is a side elevational view of the hood-connector assembly of FIG. 1 illustrating various hood elements partly broken away and in section, disposed in engagement with a connector plug mounted on a chassis plate;

FIG. 16 is a side elevational view similar to that of FIG. 15 illustrating the hood connector assembly of FIG. 4 in assembled relationship with a connector receptacle mounted on a chassis plate;

FIG. 17 is an end elevational view of the inside of one of the hermaphroditic hood halves made in accordance with the teachings of this invention;

FIG. 18 is a sectional view taken on line 18—18 of FIG. 17;

FIG. 19 is an end elevational view of the exterior of one of the hood halves made in accordance with the teaching of this invention;

FIG. 20 is a side elevational view of a connector having an all plastic insulator which may be employed with the various hood constructions of this invention disposed on a mounting plate;

FIG. 21 is a view similar to that of FIG. 20 illustrating a metal connector having detachable mounting lugs which may be employed with the various hoods of the provided invention disposed on a mounting plate; and FIG. 22 is a fragmentary sectional view illustrating an alternative securing means which may be employed for attaching a connecting lug to a metal connector body.

DESCRIPTION OF THE INVENTION

Figure 7:
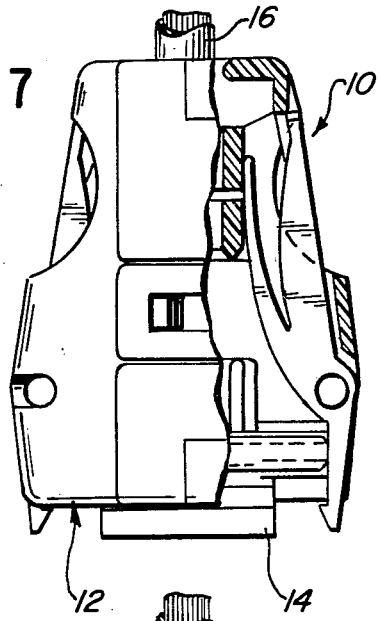
FIG. 7 is a side elevational view broken away and partly in section of the hood-connector plug assembly of FIG. 1.

Referring now more particularly to FIG. 1 a hood-electrical connector assembly 10 is illustrated comprising an assembled hood 12 in overlying protective relationship with a connector plug 14. Connector 14 is a connector plug of a type sold by TRW Inc. of Elk Grove Village, Ill. under the name D-Subminiature Connectors. Such connectors are designed for use in those applications where space and weight are of prime importance. The connector 14 is also recognized as a high density contact connector which is especially well-suited for aircraft, missile and similar applications.

Although the connectors illustrated in the drawings are of such "Subminiature" type, the structural detail hereinafter presented with respect to the hood constructions of this invention are readily adaptable to other well-known connector constructions, such as the solderless connectors sold by TRW Inc. under the tradename Superibbon.

it will be noted from the exploded view of FIG. 3 that cable 16 fragmentarily illustrated has crimped thereto a strain relief collar 18 having opposed projections 20. Cable 16 also has a plurality of conductors 22 extending from terminal sheath end 24 of the cable 16. The conductor ends are terminated in electrical engagement with metal contacts disposed within the illustrated conductor plug 14. Projecting pins 16 of plug 14 are seen in FIGS. 1 and 3 extending within an encompassing skirt 18. The connectors 14 may comprise an all-plastic insulator body in which metallic contacts having the pin ends 16 are mounted, or may comprise subminiature connectors containing a metal shell, a glass-filled insulator and copper contacts which may be gold plated for improved electrical conductivity.

The hood construction 12 of FIG. 3 comprises opposed hermaphroditic half portions 26R and 26L which are reciprocally movable into a releasable interlocking engagement wherein the connector 14 is snugly enveloped and the terminations made between the connector contacts and conductors 22 protected. Each hood half 26R and 26L has opposed parallel side wall portions 28 and 30 on which are disposed a C-shaped latching collar 32 and a wedge-shaped locking detent 34 respectively, as is most clearly seen in FIG. 3. Inclined surface 36 of the projecting detent 34 disposed on wall 30 of hood half 26L is located between guide edges 38 which define an interval adapted to snugly receive the width of latching collar 32 when the two hood halves are in assembled relationship.

Also serving to guide the mating hood halves 26L and 26R into interlocking relationship are projecting tongue wall portions 40 and 42 having the adjacent, opposed edges 38 which define a slot for receiving the locking collar 32. The projecting wall portions 40 and 42 are received in the guiding slots of the opposed hood half 26R as illustrated in FIG. 3. The slots of opposed wall portion 40 of hood half 26R for receiving projecting tongues 40, 42 are defined by edges 44 and 46, the latter edges being the lower edge of wall raised guide portion 50 and an upper edge of locking collar 32 as illustrated in FIG. 3. Interlocking wall portion 42 of the hood half 26L as viewed in FIG. 3 is received in a slot defined by edges 52 and 54 on wall 28 of hood half 26R. Edge 52 comprises the bottom edge of locking collar 32 and edge 54 comprises an upper edge of raised guide element 56 formed on surface 28 of hood half 26R as illustrated in FIG. 3.

Integrally formed with opposed wall portions 28 (and 30 not seen) of hood half 26R as viewed in FIG. 3 is a slotted half collar 58 having formed therein a transverse slot 60 as is more clearly seen in FIG. 17. Hood half 26L has the identical collar structure as is most apparent from FIG. 19. It is the function of the slotted collar 58 to compress therebetween strain relief ferrule or collar 18 attached to the cable 16 with the projecting tongues 20 of such ferrule being received in the opposed slots 60 when the hood halves 26R and 26L are in assembled relationship with the cable connector assembly of FIG. 3 so as to form the compact, interlocked assembly of FIG. 1.

FIGS. 17 and 19 also illustrate transverse spacing band 64 which serves to maintain the opposed walls 28 and 30 in spaced relationship in each hermaphroditic hood half 26R and 26L. Formed in the bottom longitudinal edge portions of the opposed hood half walls 28 and 30 are dove-tailed grooves 68 adapted to matingly, slidably interfit with opposed longitudinal edges of the electrical connector to be received within the cavity defined by the hood halves 26L and 26R in the mated condition. FIGS. 3 and 6 illustrate longitudinal edges 70 of the connectors 14 prior to being slidably received within the dove-tailed grooves 68 of the hood halves and prior to forming the completed assemblies of FIGS. 1 and 4 respectively.

Pivotally mounted in the opposed hood halves 26R and 26L of the hood 12 of FIGS. 1, 2, 3 are finger-actuatable latching arms 72 having a main arm portion 74 which is transversely apertured at 76 and having a terminal latching detent portion 78. Formed integrally with main arm 74 is a thinner, resilience-imparting or spring arm 81 joined to main arm 72 at juncture 82. Each arm 72 is mounted in a hood half by means of a pivot pin 80 of FIG. 3. The pins 80 are received in annular openings 84 of each hermaphroditic hood half, see FIG. 18. A pin-receiving aperture 84 is also illustrated in each of the hood halves 26R and 26L in FIGS. 3 and 6. As an alternative to the use of separable latching arms 72 and pins 80 each arm and pivot pin may be integrally formed as latching units 73 illustrated in FIG. 3A. Units 73 are of the same construction as arms 72 with the exception that pivot shafts 75 are integrally formed therewith. Units 73 may be assembled with each hood half 26R or 26L by wedging the shafts 75 between the walls 28, 30 of each half until the shafts snap into place in the receiving apertures 84.

In mounted position, each latching arm 72 or unit 73 has its resilient arm portion 81 biased against an outer peripheral portion of an annular half collar 58 in the manner more clearly seen in FIG. 2. Each main arm 74 of each latching arm 72 has a terminal stop finger 86 (see FIG. 3) which engages inner stop surface 88 of transverse band portion 90 of each hermaphroditic hood half (see FIG. 18).

In the normal course of assembling the hood-connector elements illustrated in FIG. 3 (after the latching arms 72 or units 73 have been pivotally mounted in proper disposition within each hermaphroditic half portion 26R and 26L) the hood halves are moved together so as to receive the projecting tongues 20 of the cable ferrule 18 in the slots 60 of the opposed half collars 58 comprising integral portions of the hood halves. Simultaneously, longitudinal edge portions 70 of the connector 14 are received in the dove-tailed grooves 68, see FIG. 19. At the end limit of the hood half movement toward each other, locking detent 34 is disposed on each hood hermaphroditic half is received in the locking collar 46 of the opposed half and the hood halves are guided into desired relationship by means of the interengaging guide wall portions and receiving slots above discussed in some detail.

In the interlocked position of FIG. 1, connector 14 is snugly received within the cavity defined by the hermaphroditic hood halves 26R and 26L and the two hood halves are securely locked together. Also, each of the dove-tailed grooves 68 formed in the opposed side wall portions 30 and 28 of each hermaphroditic hood half has an inner stop end 96, see FIG. 18. The interval between the opposed stops 96 when the hood halves are in the interlocked condition of FIG. 2 is adapted to snugly receive the length of the connector 14 therebetween so as to prevent any relative movement between the hood and connector.

It is the function of the latching arms 72 or units 73 pivotally mounted in the hood halves of the provided hood 12 to interlockingly engage latch elements such as elements 100 of connector receptacle 102 illustrated in FIG. 2 secured to a chassis mounting plate 104 by means of screws 106. The screws 106 threadedly engage internal threads 108 of a bushing 110 mounted in the interior of each of the two latch elements 100 illustrated in FIG. 2. The connector receptacle 102 of FIG. 2 may be formed of plastic such as a polyester, the entire connector including the latch arms may be integrally formed of plastic with the exception of the metal contacts 112 mounted therein.

It is the function of the pivotal latching elements 72 or units 73 mounted in the two hermaphroditic hood portions 26R and 26L, to engage by means of the detent portions 78, latching surfaces 114 formed on each latching element 100 of connector 102. Thus, in FIG. 2 upon insertion of connector plug 14 into connector receptacle 102, latch arms 72 will lockingly engage surfaces 114 of latch portions 100 of the connector receptacle 102 in the manner more clearly seen in FIG. 15. It will also be clearly seen from FIG. 2 that beveled surfaces 79 of detent portions 78 of latching element 72 cooperate with beveled surfaces 109 of connector latch portions 100 in wedging elements 72 apart until the detent portions thereof snap into locking engagement with latching surfaces 114 during intermating of connectors 14 and 102.

It will be appreciated from an examination of FIGS. 2 and 3 that when utilizing the hood 12 of FIG. 1, the connector received therein will be a connector such as plug 14 of FIGS. 1, 2, 3 having no latching elements integrally formed therewith. If such latching elements were present such connector would not fit within the cavity defined by the hood 12. Thus the provided hood is adapted to protectively envelope a connector such as connector 14 and latchingly engage a connector such as illustrated connector 102 which does have latch elements 100 formed integrally therewith or mounted thereon.

In the event it becomes necessary to mate a connector such as plug 14 of FIG. 6 with a connector having no latching elements, such as a connector receptacle 103 of FIG. 20 (without latching blocks 107), the hood hermaphroditic halves 26R and 26L may employ filler members 116 illustrated in FIG. 6 of the drawing. It will be noted from the latter figure that each filler member has a normally outwardly disposed side comprising an upper arcuately-faced segment 118 contiguous with an intermediate vertical segment 120 which connected by means of a ledge 122 and underlying straight segment 124 having a face parallel to the surface of segment 120 in the vertical plane on the normal position of use. The lowermost segment of each filler 116 possesses a beveled surface 126. In such position of use illustrated in FIG. 5, the normally inwardly disposed surfaces are 128 and 130A and 130B, the latter two surfaces being disposed at a slight angle to each other as more clearly seen in FIG. 6.

Extending longitudinally through a central body portion of each filler member is a screw-receiving aperture 132 adapted to receive a screw 134 which may have an upper unthreaded shank portion 136 and a lower threaded portion 138. The diameter of the filler aperture 132 is of sufficient size so as to allow the threaded screw portion to readily pass therethrough. Molded integrally with each rear surface 128 of each filler 116 is a thin ribbed member 140 having opposed beveled end edges 142.

Each screw 134 may be retained within the aperture 132 by staking the plastic from which the filler is formed by means of a punch of the like applied to a surface 130A or 130B, or both, in the manner more clearly seen in FIG. 5 of the drawing. Punch indentation 146 is also clearly illustrated in FIG. 5. The inwardly projecting deformation of the plastic of the filler in aperture 132 will cause the screw 134 to remain captured in aperture 132 of the filler as the plastic deformation forms a stop preventing withdrawal of the screw from the aperture 132 by engaging the larger screw diameter formed by threads 138. The plastic projection permits slidable movement of the screw unthreaded shank portion relative thereto. Such manner of screw retention comprises no part of this invention as it comprises the inventive contribution of Fred H. Scheeler and is more fully disclosed in application Ser. No. 014,319, filed Feb. 23, 1979. The latter disclosure is presented to insure that the best mode of carrying out the invention of this application is provided.

In the normal course of assembly of each hood filler 116 to each hood half 26R and 26L the fillers are forced upwardly and along the dotted line axes illustrated in FIG. 6 spreading the opposed side wall portions 28 and 30 apart. It will be noted that upper edges of each filler member 116 are beveled at 148 to facilitate wedging between the opposed side walls of each hood half. Each filler is forced upwardly so that each rib 140 disposed on rear surface 128 of each filler tangentially engages the arcuate rear surface of each collar 58 in the manner seen in FIG. 5.

The filler is forced upwardly until lower edge 64L (FIG. 17) of each transverse band 64 of each hood half engages ledge 122 of each filler member. As this relationship is assumed, rear surface 150 of each filler lower segment portion 126 (FIG. 6) will "snap" behind outer terminal ends 152T (see FIG. 18) of the projecting portions 152 (FIG. 7) formed on the inner surface of each hood half which cooperate to form the dove-tailed groove 68.

From this "snap in" relationship illustrated in FIG. 5 it will be noted that the outer surfaces of transverse band 64 together with outer surface of filler segment 124 form a smooth surface presenting the appearance of an integral molded construction. It will be noted that the lower bevel of the transverse band 64 and the upper ledge surface 122 on the segments 124 also intermate as to provide the finished appearance of FIG. 5.

Figure 8:
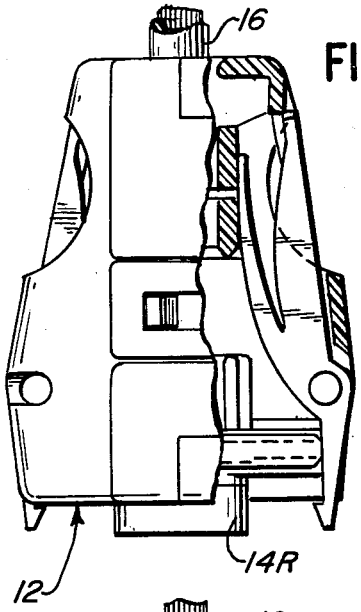
FIG. 8 is a side elevational view similar to that of FIG. 7 illustrating the hood of FIG. 7 in assembled relationship with a connector receptacle.

The flexibility inherent in the provided hood constructions is apparent from various figures of the drawing. In FIG. 7 the hood (12) connector (14) assembly 10 of FIG. 1 is illustrated. In FIG. 8 the hood assembly 12 of FIGS. 1, 2, 3 is illustrated in assembly with a connector receptacle 14R.

Figure 9:
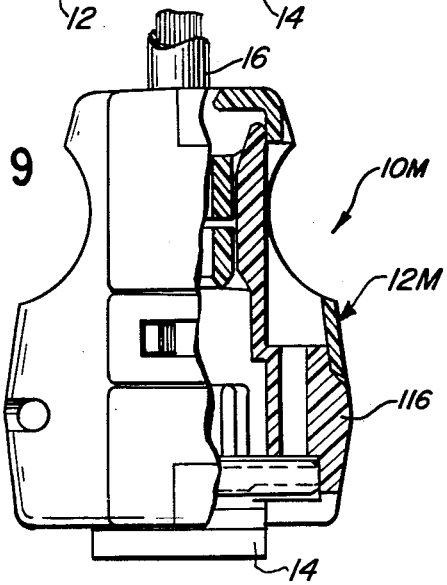
FIG. 9 is a side elevational view similar to that of FIG. 7 illustrating the hood of FIGS. 4 through 6 in assembled relationship with a connector plug, no screws being utilized.
Figure 10:
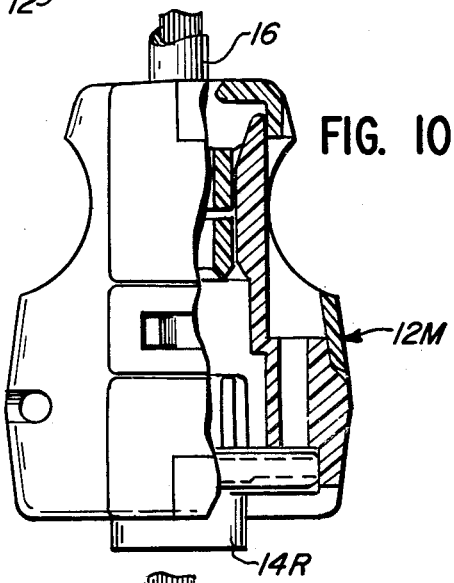
FIG. 10 is a side elevational view similar to that of FIG. 9 illustrating the hood of FIG. 9 in assembled relationship with a connector receptacle.

In FIG. 9 the hood-connector assembly of FIG. 4, 10M, is illustrated except the filler members 116 do not have retained screws. FIG. 10 is a view similar to FIG. 9 with the exception that the modified hood assembly 12M is illustrated in combination with the connector receptacle 14R.

Figure 11:
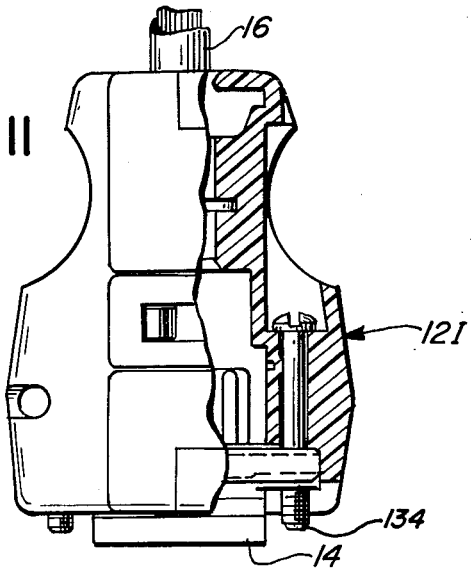
FIG. 11 is a side elevational view similar to that of FIG. 9 illustrating the hood of FIG. 9 with the hood and filler integral and in assembled relationship with screw members adapted to retentively secure a connector receptacle adapted to mate with the illustrated plug.
Figure 12:
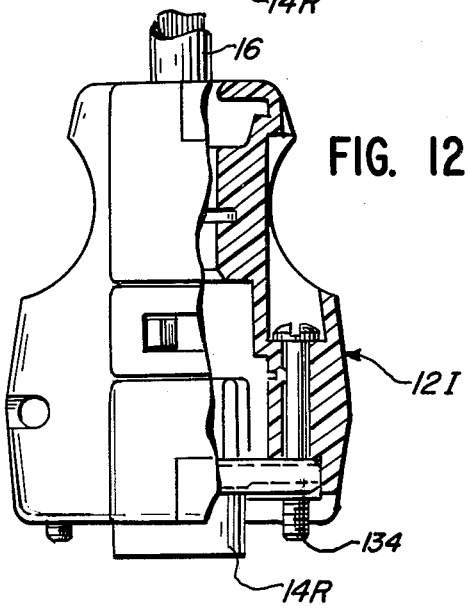
FIG. 12 is a side elevational view similar to that of FIG. 11 illustrating the hood assembly of FIG. 11 in assembled relationship with a connector receptacle.

FIGS. 11 and 12 are similar to FIGS. 9 and 10 with the exception that the filler members are illustrated in combination with retained screws 134 and the filler are molded integrally into each hood half to form the integral half units 12I.

In the intermating hood-connector assembly of FIG. 13, the hood-connector assembly of FIGS. 1, 3 is illustrated in intermating interlocking relationship with the modified hood construction 12M of FIGS. 4 through 6 in which the filler members 116 are employed without the screw members 134. The modified hood 12M is illustrated in interlocking relationship with connector 102 illustrated in FIG. 2 of the drawing, the latter connector having integrally formed therewith spaced latching elements 100. It is readily apparent from FIG. 13 that when the plug 14 housed within the overlying hood 12 engages the receptacle 102, detents 78 of latching arms 72 of the hood 12 engage latch portions 100 of the connector receptacle 102. It will be seen from FIG. 13 that in the course of the connectors 14 and 102 intermating, beveled edges 109 of the latch portions 100 of the connector 102 will wedge apart the latching arms 72, forcing the same to slightly pivot about pins 80 as the spring arm portions 81 are slightly compressed. Upon such compression the detent portion 78 of each latching arm 72 will lockingly engage surface 114 of each latch portion 100 of the connector receptacle 102.

If it is desired to disengage the two hood-connector assemblies illustrated in FIG. 13, all that need be done is inwardly pivot the latching arms 72, thereby forcing the main arms 74 to compressingly move toward the spring arms 80, simultaneously outwardly pivoting the detent portions 78 which will become unlatched from the latch portions 104 of the connector 102. FIG. 14 illustrates two hoods 12M in which screws 134 of the upper hood secure the two hood-connector assemblies together by engaging threads 108 of bushing 110 (FIG. 2) disposed in opposed ends of connector 102 housed within the lower hood 12M.

FIG. 15 is a sectional view partly in section and partly in elevation showing the hood-connector assembly 10 of FIG. 2 after latching engagement; connector 102 is mounted on chassis plate 104 by means of screws 106.

FIG. 16 is a side elevational view illustrating modified hood-connector assembly 10M of FIG. 5 in engagement with the connector 102. The screws in fillers 116 are being employed for hood-connector assembly-connector retention purposes.

Although the foregoing discussion was specific with respect to all plastic connectors it is apparent that the provided hood constructions will work to equal advantage with metal-shell connectors such as connector 160 of FIG. 21. Connector 160 comprises a nine position CE interface connector having latching blocks 162 secured to opposed end portions thereof by means of screw members 164 which threadably engage the lower portions of bushing members 167 disposed on the inside of each latching block 162. The screws 164 simultaneously secure the connector to apertured plate 104 in which connector 103 is nestably received.

As an alternative to the use of the bushings 110 in the connectors 102 having the latching elements 100 integrally formed therewith (FIG. 2), bushing-stud element 166 of FIG. 22 may be substituted for bushing 110. Element 166 comprises an upper bushing portion 168 having a stud 170 projecting from the lower portion thereof which may be employed for locking the illustrated connector 102M to a chassis plate 104 by means of a locking nut 172. Whereas the provided hood constructions have been described as engaging connectors such as connector 14 of FIG. 1 without integral latching means and connectors such as connector 102 of FIG. 2 with latching means integrally formed therewith, connector 103 of FIG. 20 may be employed which is similar to metal shelled connector 160 of FIG. 21. The plastic body of connector 103 may employ detachable, plastic, latching blocks 107 which are detachably secured by means of screws 164 which engage the lower threads of bushings 167 as they secure the connector to plate 104. Such a connector may, therefore, be employed with hoods having latching arms or fillers.

It should be appreciated that although the foregoing description has described the basic hermaphroditic hood half assemblies 12 and 12M as being detachably connected to either latching arms 72 (or unit 73) or filler members 16, it will be apparent that the provided hood constructions above discussed and illustrated in the drawing may comprise permanent assemblies. Accordingly, the latching arms and filler members may be permanently attached to the mating hood halves in which disposed. It was made apparent from FIGS. 11 and 12 that the filler members may be molded integrally into hermaphroditic hood halves. It will be noted from FIG. 2 of the drawing that the pivotal latch arms may be permanently pinned in place if the pins 80 are not necessarily removable as the pin ends may be upset to form locking means.

The foregoing is believed to have made apparent the flexibility in use permitted by the provided invention. The described hood halves may be readily snapped together over an electrical connector plug or receptacle and simultaneously clamp a cable portion and ferrule for strain relief purposes. The hood-connector assembly may simultaneously subsequently mate with a second connector and positively interlock therewith. The provided latch arms and filler members with attached screws employed with the hoods of this invention may be utilized for assuring permanence and rigidity of assembly in the manner above described in the description of the various figures of the drawing. The provided hoods and connectors may be formed from a number of plastics such as various polyesters. The latch arms provided provide both automatic latching with connector mating, and instantaneous latch release through finger actuation.

It is apparent that the specific details of construction of the hood members disclosed may be modified to conform with the specific configuration of the connectors employed therewith. Accordingly, it will be noted that if the above-described hoods were provided with the metal shell connectors 116 of FIG. 21, receiving slots of the mating hood halves will, of course, be modified to accommodate the narrower edges of the peripheral flange of the connector 160.

The provided hoods enable connection of a hood-connector assembly to other hood connector assemblies as previously described, and, in addition, provide for ready assembly to connectors mounted on chassis plates. The assembly may be readily disengaged either by a mere manual squeezing of the pivotal latching arms or of the simple act of screwing of the screws the hood constructions wherein the filler members are utilized. It is believed that the foregoing description has made apparent a number of modifications which may be made in the constructions disclosed which will remain within the ambit of the invention above described. Accordingly, this invention can be limited only by the scope of the appended claims.

What is claimed is:

1. In a hood construction for an electrical connector, mating hood portions for forming a first connector-receiving cavity in the mated condition; means on said hood portions for locking said hood portions together when said hood portions are urged into the mated condition; means for mounting a plurality of different connector interlocking means in each hood portion, and a plurality of different connector interlocking means for detachably mounting in each hood portion mounting means; each of said different connector interlocking means being adapted to releasably engage cooperative elements in fixed relationship to a second connector mating with a first connector disposed in said hood cavity to retain those connectors in fixed relationship with one another.

2. In a hood construction for an electrical connector, the combination comprising mating hood portions for forming a first connector-receiving cavity in the mated condition; means on said hood portions for locking said hood portions together when said hood portions are urged into the mated condition; a plurality of different means housed within each hood portion for selectively mounting a plurality of different connector interlocking means within each hood portion; each of such different connector interlocking means being adapted to releasably engage cooperative elements in fixed relationship to a second connector mating with a first connector disposed in said hood cavity to retain those connectors in fixed relationship with one another; and a connector interlocking means mounted in the mounting means of each hood portion.

3. The construction of claim 1 or 2 wherein said hood portions are formed of plastic.

4. The hood construction of claim 1 in which said hood portions are hermaphroditic hood halves.

5. The construction of claim 1 or 2 wherein said interlocking means is formed of plastic.

6. In a hood construction for an electrical connector having a cable attached thereto, mating hood portions reciprocally movable into latching and unlatching engagement along an axis of movement; said portions simultaneously defining a cavity having a first cavity portion for receiving a first electrical connector, and a second cavity portion for receiving a cable connected to such electrical connector; slot means disposed in facing portions of said hood portions defining said second cavity portion for receiving a projecting ferrule portion disposed on a cable received in said second cavity portion, and interlocking means comprising an apertured filler member having a connector-engaging screw retained therein mounted on each of said hood portions for detachable engagement with cooperative means in fixed relationship with a second electrical connector mating with a first electrical connector when disposed in said first cavity portion; said mating hood portions having mutually engageable means thereon for locking and guiding said good portions together when said hood portions are urged into latching engagement.

7. A hood construction for use with first and second mating connectors having electrical contacts therein, comprising mating hood portions; said hood protions including mutually engageable first means for locking said hood portions together when said hood portions are urged into the mated condition; said hood portions in the mated condition defining a cavity for snugly receiving such first mating connector; interlocking means comprising an apertured filler member having a connector-engaging screw retained therein, mounted on each of said hood portions defining said hood construction for interlocking engagement with cooperative elements in fixed relationship to a second connector when mated with such one connector to retain such connectors in mated relationship with one another; and second means disposed in each of said hood portions for engaging a conductor cable supplying conductors to such first connector contacts and effecting a strain relief function simultaneously with the attaining of the mated condition between said hood portions.

8. The construction of claim 6, or 7 in combination with a first connector received in said hood cavity and a second connector disposed in mating engagement with said first connector; and means on spaced portions of said second connector having threaded openings for releasably engaging the hood screws.

9. The construction of claim 6 or 7 in which said filler members releasably interfit with said mating hood portions.

10. The construction of claim 6 or 7 in which said filler members are formed integrally with said mating hood portions.

11. The hood construction of claim 1, 2, 6 or 7 in which said hood portions are hermaphroditic hood halves; each hood portion having latch elements disposed on opposed side surfaces thereof, and having guide means for guiding said hood halves into interlocking engagement disposed on opposed side surfaces of said hood halves.

12. The hood construction of claim 1 or 2 in which each of said hood portions has a cable-engaging portion adapted to engage a cable supplying electrical conductors to a connector received in the connector-receiving cavity and provide a strain relieving function.

13. In a hood construction for an electrical connector having a cable attached thereto, mating hood portions reciprocally movable into latching and unlatching engagement along an axis of movement; said portions simultaneously defining a first cavity portion for receiving a first electrical connector, and a second cavity portion for receiving a cable connected to such electrical connector; means disposed in facing portions of said hood portions defining said second cavity portion for receiving a projecting ferrule portion disposed on a cable received in said second cavity portion, and interlocking means mounted on each of said hood portions for detachable engagement with cooperative means in fixed relationship with a second electrical connector mating with a first electrical connector when disposed in said first cavity portion; said mating hood portions having mutually engageable means thereon for locking said hood portions together when said hood portions are urged into latching engagement; said interlocking means comprising an integral latch arm having a latch element disposed at an end portion thereof; said latch element extending from a bifurcation defined by diverging latch arm segments resiliently movable relative to each other.

14. A hood construction for use with first and second mating connectors having electrical contacts therein, comprising mating hood portions; said hood portions including mutually engageable first means for locking said hood portions together when said hood portions are urged into the mated condition; said hood portions in the mated condition defining a cavity for snugly receiving such first mating connector; spaced interlocking means mounted on said hood construction for interlocking engagement with cooperative elements in fixed relationship to a second connector when mated with such one connector to retain such connectors in mated relationship with one another; and second means disposed in each of said hood portions for engaging a conductor cable supplying conductors to such first connector contacts and effecting a strain relief function simultaneously with the attaining of the mated condition between said hood portions; said interlocking means comprising an integral latch arm having a latch element disposed at an end portion thereof; said latch element extending from a bifurcation defined by diverging latch arm segments resiliently movable relative to each other.

* * * * *